US008505555B1

(12) United States Patent
Lightfoot-Martin

(10) Patent No.: US 8,505,555 B1
(45) Date of Patent: Aug. 13, 2013

(54) HIDDEN FOUNDATION FOR FORMING HAIR AND METHOD OF USE

(75) Inventor: Leigh F. Lightfoot-Martin, Merritt Island, FL (US)

(73) Assignee: Accessory Maven, LLC, Merritt Island, FL (US)

( * ) Notice: Subject to any disclaimer, the term of this patent is extended or adjusted under 35 U.S.C. 154(b) by 0 days.

(21) Appl. No.: 13/317,302

(22) Filed: Oct. 15, 2011

(51) Int. Cl.
*A45D 8/40* (2006.01)

(52) U.S. Cl.
USPC ..... 132/274

(58) Field of Classification Search
USPC ..... 132/273, 274; D28/39, 41
See application file for complete search history.

(56) References Cited

U.S. PATENT DOCUMENTS

| | | | | |
|---|---|---|---|---|
| 873,163 | A * | 12/1907 | McNeil | 132/281 |
| 3,126,019 | A * | 3/1964 | Sidelman | 132/54 |
| 6,276,368 | B1 | 8/2001 | Giamalva | |
| 8,074,664 | B2 * | 12/2011 | Ruckdeschel | 132/275 |
| 2012/0138077 | A1 * | 6/2012 | Stuhler | 132/200 |

* cited by examiner

*Primary Examiner* — Rachel Steitz
(74) *Attorney, Agent, or Firm* — MacMillan, Sobanski & Todd, LLC

(57) ABSTRACT

A hidden foundation for forming hair into a ponytail or elaboration of a ponytail hair style includes a bulbous member connected to a flared member by a waist. The flared member is placed adjacent the back of the user's head and hair is gathered around the hidden foundation. An elastic band is then placed around the hair at the waist to hold the hair in place. A storage cavity for storing articles is disposed within the hidden foundation. In another embodiment, the hidden foundation comprises a cage structure which is open and can receive hair fasteners.

16 Claims, 7 Drawing Sheets

HIDDEN FOUNDATION FOR FORMING HAIR AND METHOD OF USE

CROSS REFERENCE TO RELATED APPLICATION

None

TECHNICAL FIELD

The present invention pertains generally to hair styling, and more particularly to a hidden foundation which is used to form a ponytail and other ponytail-based hairstyles such as full or partial buns or chignons.

BACKGROUND OF THE INVENTION

A ponytail is a method of styling hair in which the hair is pulled away from the face and toward the back or sides of the head. The hair is then gathered and secured with an elastic tie, clip or similar fastener. In a basic ponytail the hair hangs freely from the gathering point and resembles the tail of a pony. Often wearers choose to elaborate further on the basic ponytail by braiding or twisting all or part of the ponytail and also by further wrapping, clipping, pinning or otherwise securing portions of the ponytail back onto or around the ponytail's base. A problem can exist however in each of these styles in that the elastic band or other fastener can loosen and slip down toward the base of the head or toward the end of the hair by means of gravity, windy conditions and normal movement by the wearer. Furthermore, the wearer often experiences scalp discomfort where the hair is gathered tightly into a ponytail from scalp sweating or pulling and chafing at the gather point. Additionally, a problem exists that in order for the hair to have a desirable appearance of volume and the intended ideal shape of ponytail or the styles extending from a basic ponytail, many wearers of ponytails and ponytail-based hairstyles find they must first curl, tease, or back-comb the hair prior to gathering it in an elastic band and they often must also use one or more additional hair product chemicals such as hairspray, gel, mousse, pomades and the like in order to keep the basic ponytail and ponytail-based styles from slipping, loosening, or becoming flattened throughout the period while worn.

BRIEF SUMMARY OF THE INVENTION

The present invention is directed to a hidden foundation for forming hair. The hidden foundation comprises a ponytail and styling enhancements thereof which is designed to be inserted inside the wearer's gathered ponytail in order to cause the ponytail or its further elaborations to appear to be thicker, fuller and shapelier, and which provides for increased stability in securing the hair while allowing the wearer to form their desired style using little or no other styling chemicals or styling processes. As such, the hidden foundation benefits the environment by reducing chemical pollution. The foundation provides enhanced overall volume to the top and sides of the hair as well as acting as a strain relief by keeping the weight of the ponytail from pulling on the scalp. The weight of the ponytail is removed from the stress point around the elastic band so the style is more comfortable to wear for long periods, while also making it cooler by means of increased airflow and helping to hold the style more securely. The hidden foundation provides a full and classically "candle flame" shaped ponytail achieved by means of the manner in which the bulbous member of the foundation widens out from its "waist".

The hair may then be further styled by braiding or wrapping the ponytail back around its base. A cage embodiment provides several openings into and through which optional clips, pins and hair sticks can be inserted for additional adornment, thus relieving the user of the necessity of securing the hair to itself which is less stable and which may damage the hair. By means of its hollow core the user is also provided with a small concealed storage chamber for small articles such as extra pins or clips or other personal items they may wish to carry. Further, due to the hollow core, the wearer may benefit from a cooling effect caused by increased airflow which helps to relieve scalp sweating. Additionally, the waist of the device bears the majority of the tension caused by the elastic band fastener so that the wearer can achieve relief from the weight of their hair pulling at the gather point and the attendant chafing and irritation.

In accordance with an embodiment, a hidden foundation for forming hair includes a bulbous member, a flared member having a large end and an opposite small end, and a waist which connects the small end of the flared member to the bulbous member.

In accordance with another embodiment, a central longitudinal axis passes through the bulbous member, the waist, and the flared member. The bulbous member has a truncated ellipsoidal shape having a minor axis which is coaxial with the central longitudinal axis.

In accordance with another embodiment, the flared member has a conical frustum shape having a central axis which is coaxial with the central axis.

In accordance with another embodiment, the bulbous member does not have an external aperture through which the hair must pass.

In accordance with another embodiment, the hidden foundation cooperates with an elastic band, wherein the waist is shaped and dimensioned to circumferentially receive the hair and the elastic band.

In accordance with another embodiment, the flared member includes a storage cavity which is accessible from the large end.

In accordance with another embodiment, the storage cavity extends into the bulbous member.

In accordance with another embodiment, the hidden foundation is fabricated from one or more chemically-stable materials which will not interact with or be affected by hairspray, alcohol-based or petroleum-based styling products nor interact with or be affected by contact with chemically-treated and processed hair.

In accordance with another embodiment, the hidden foundation has a length and the bulbous member has a maximum width. The ratio of the length to the maximum width is about 1.25.

In accordance with another embodiment the waist has a minimum width, and a ratio of said maximum width to said minimum width is about 1.5.

In accordance with another embodiment, the waist is disposed about one inch from the large end of the flared member.

In accordance with another embodiment, the large end of the flared member is elliptical and has a major axis and a minor axis.

In accordance with another embodiment, the hidden foundation has a waist angle which is between about 118° and about 138°.

In accordance with another embodiment, the bulbous member includes a cage which has a plurality of connective members and a plurality of openings; and the flared member includes a cage which has a plurality of connective members and a plurality of openings.

Other embodiments, in addition to the embodiments enumerated above, will become apparent from the following detailed description, taken in conjunction with the accompanying drawings, which illustrate, by way of example, the principles of the hidden foundation for forming hair and method of use.

DETAILED DESCRIPTION OF THE INVENTION

Figure 6:
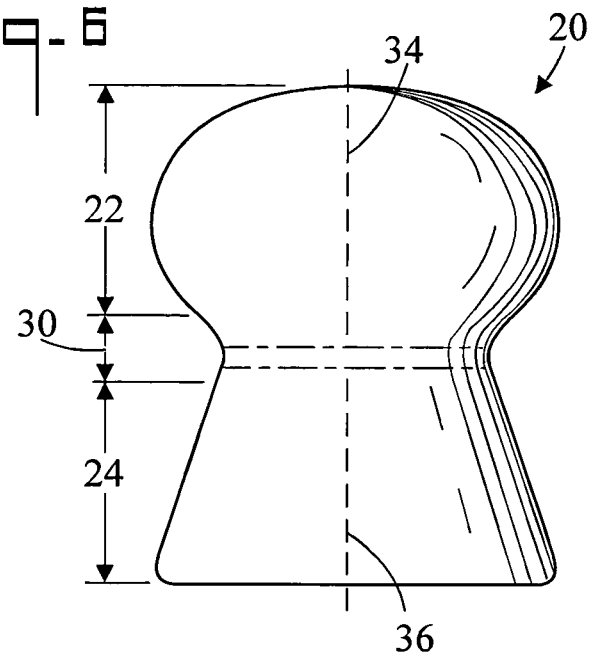
FIG. 6 is another side elevation view of the hidden foundation.

Referring initially to FIGS. 1-5, there are illustrated top perspective, bottom perspective, top plan, side elevation, and bottom plan views respectively of a hidden foundation for forming hair, generally designated as 20. As used herein, the term "hidden" means that hidden foundation 20 is placed in the hair of a user, it is surrounded by the hair and thereby hidden from view (refer to FIG. 8 and the associated discussion). Hidden foundation 20 includes a (1) a bulbous member 22, (2) a flared member 24 which has a large end 26 (circular in the shown embodiment) and an opposite small end 28, and (3) a waist 30 which connects small end 28 of flared member 24 to bulbous member 22. A central axis 32 passes through bulbous member 22, waist 30, and flared member 24 (refer to FIGS. 4 and 5). Referring also to FIG. 6, bulbous member 22 has a truncated ellipsoidal shape (i.e. flattened sphere) having a minor axis 34 which is coaxial with central longitudinal axis 32. That is, bulbous member 22 is flattened along central longitudinal axis 32. It may be appreciated however, that bulbous member 22 could alternatively have the shape of a truncated sphere. It is further noted that unlike some prior art devices, bulbous member 22 is closed and specifically does not have an external aperture through which hair must pass.

In an embodiment, flared member 24 has a conical frustum shape which has central axis 36 (refer to FIG. 6). Central axis 36 is coaxial with central longitudinal axis 32. Also referring to FIG. 7, flared member 24 includes a storage cavity 38 which is accessible from large end 26. That is, large end 26 is open to storage cavity 38 so that articles 600 may be stored therein. (refer to FIG. 9 and the associated discussion). In an embodiment, storage cavity 38 extends into bulbous member 22 (refer to FIG. 7).

Waist 30 comprises a necked down region between bulbous member 22 and flared member 24 (also refer to FIG. 6). Waist 30 is shaped and dimensioned to circumferentially receive hair 500 and an elastic band 502 (such as a rubber band) which holds it in place upon hidden foundation 20 (refer to FIG. 8 and the associated discussion).

Figure 4:
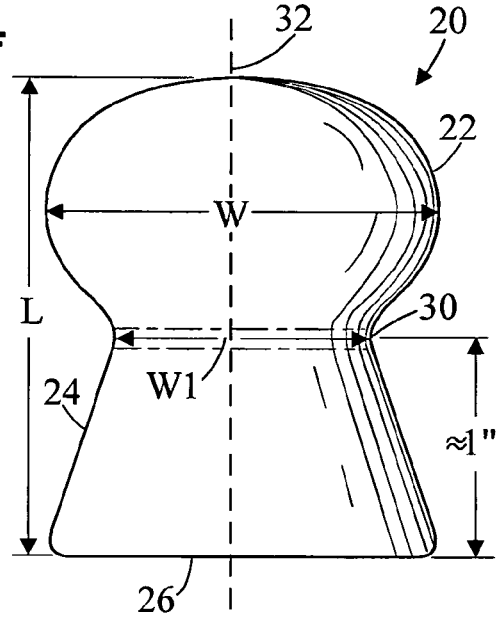
FIG. 4 is a side elevation view of the hidden foundation.
Figure 5:
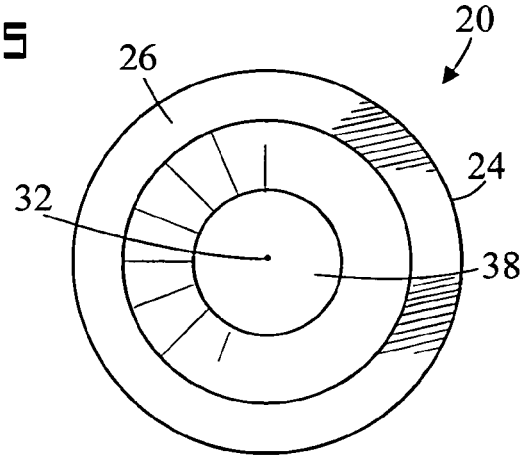
FIG. 5 is a bottom plan view of the hidden foundation.

Referring to FIG. 4, hidden foundation 20 has a length L. Bulbous member 22 has a maximum width W (widest portion). In an embodiment, a ratio of length L to maximum width W is about 1.25 ($L/W \cong 1.25$). In another embodiment, waist 30 is disposed about one inch from large end 26 of flared member 24. It may be appreciated however that hidden foundation 20 may be dimensionally scaled up or down to result in larger or smaller foundations as hair styling demands of different users may dictate. In another embodiment, waist 30 has a minimum width W1 (narrowest portion). A ratio of maximum width W to minimum width W1 is about 1.5 ($W/W1 \cong 1.5$).

In an embodiment, hidden foundation 20 is fabricated from a chemically-stable, non-reactive material. And in another embodiment, the surface of hidden foundation 20 can be textured with protrusions (such as nubs), bristles, dimples, or the like for providing additional hold on the surface.

FIG. 6 is another side elevation view of the hidden foundation 20, showing the relative location of bulbous member 22, waist 30 and flared member 24. It is noted that bulbous member 22 has the form of a truncated ellipsoid, and flared member 24 has the shape of a frustum of a cone. Minor axis 34 of bulbous member 22 and central axis 36 of flared member are both coaxial with central longitudinal axis 32 (refer to FIGS. 4 and 5).

Figure 1:
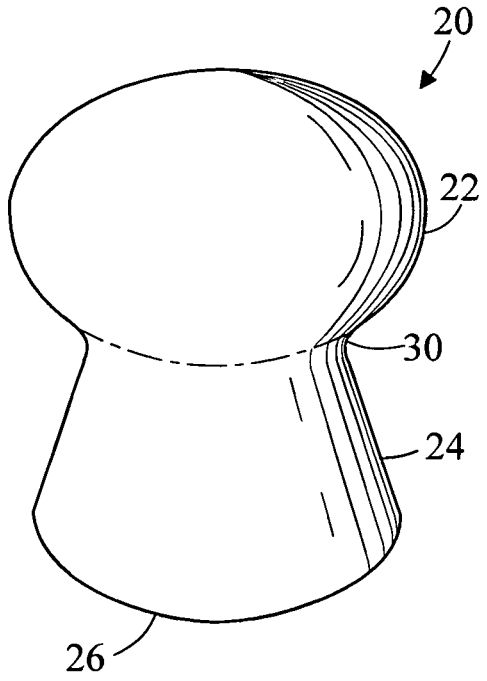
FIG. 1 is a top perspective view of a hidden foundation for forming hair.
Figure 2:
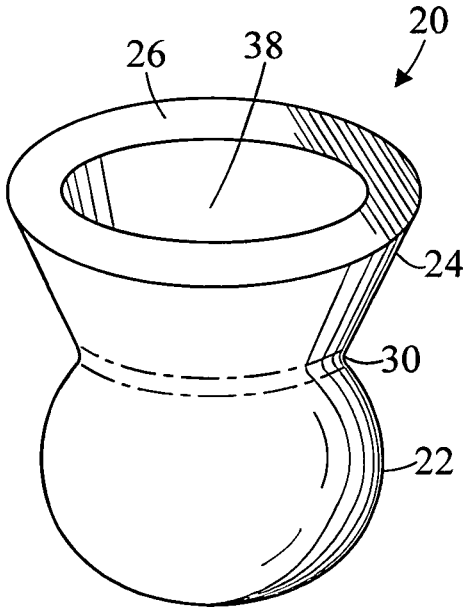
FIG. 2 is a bottom perspective view of the hidden foundation.
Figure 3:
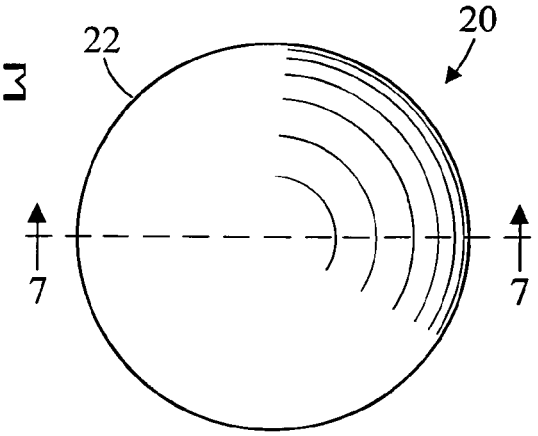
FIG. 3 is a top plan view of the hidden foundation.
Figure 7:
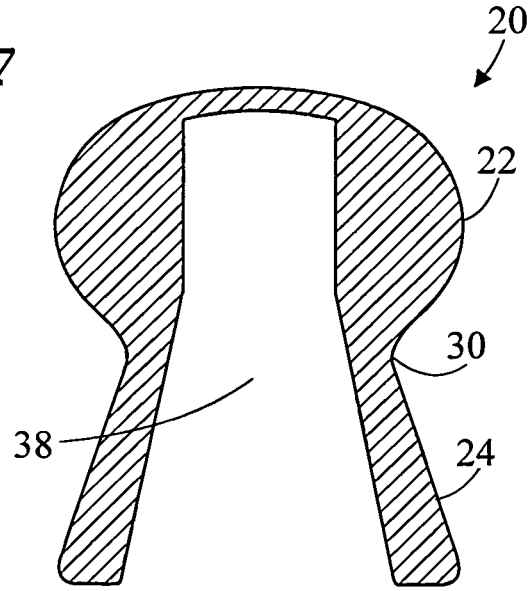
FIG. 7 is a cross sectional view along the line 7-7 of FIG. 3.

FIG. 7 is a cross sectional view along the line 7-7 of FIG. 3 showing storage cavity 38. In the shown embodiment, storage cavity 38 extends into bulbous member 22. Also, it is noted that bulbous member 22 is closed and has no external aperture for passage of hair (unlike some prior art devices which are intended to have the hair pass through them) . . . .

Figure 8:
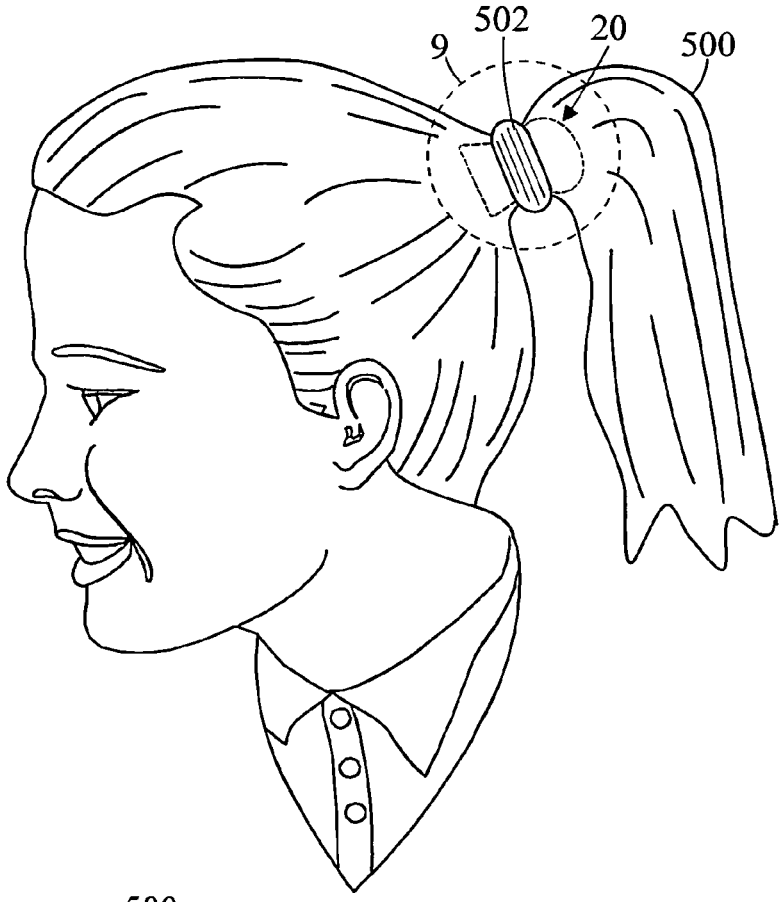
FIG. 8 is a reduced side elevation view of the hidden foundation placed in the hair of a user.

FIG. 8 is a reduced side elevation view of hidden foundation 20 placed in the hair 500 of a user. Hidden foundation 20 is placed adjacent to the back of the user's head, and hair 500 is gathered around and completely covers hidden foundation 20. Hair 500 both abuts and hides hidden foundation 20. An elastic band 502 is then placed around hair 500 at waist 30 (refer to FIG. 9) to hold hair 500 in place around hidden foundation 20. As discussed above, waist 30 is set approximately 1 inch away from the wearer's head, thus creating the illusion of greater hair volume. The wearer is able to achieve an all-over appearance of increased hair height, volume, and thickness regardless of their natural hair density or texture. The angled narrow waist 30 and its size ratio compared to bulbous member 22 and flared member 24 helps to keep elastic band 502 from loosening and slipping down the hair as normally happens when wearing a ponytail hairstyle. Additionally, the size of waist 30 is judged to be optimal for allowing the thickest and widest possible ponytail that can be achieved using the standard elastic hair bands 502 available on the market today, and its overall shape and size is applicable to the widest possible variety of hair textures and lengths. Other sizes and embodiments using the same general overall shape and critical ratio of length and width to waist size may be used for making smaller ponytails, pigtails or partial hair ponytails and ponytail-based styles. In each case, the secured portion of portions of the hair achieves all of the aforementioned benefits of enhanced volume, shapeliness, stability as well as the reduction of heat, tension and weight upon the wearer's scalp. Waist 30 allows secure binding without damaging hair 500 or sacrificing thickness, and helps to keep hair 500 securely in place so that less hairspray or other styling methods and chemicals are needed. Also, by keeping hair 500 raised off the scalp and binding it securely around waist 30 with its hollow inner core, more airflow is possible so that the user will be able to wear the ponytail in greater comfort without the scalp sweating and irritating tension at the gather point normally experienced by ponytail-based hairstyle wearers. Moreover, hidden foundation 20 makes the ponytail or ponytail-based styles seem subjectively to be virtually weightless and less irritating to the wearer due to the design of large end 26 which rests lightly and comfortably against the scalp.

Figure 9:
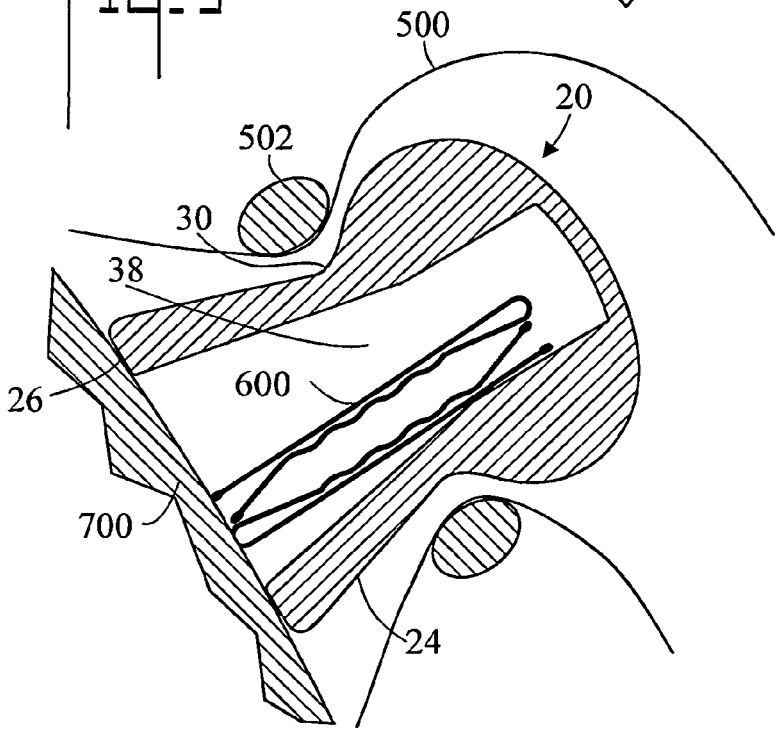
FIG. 9 is a cross sectional view of the hidden foundation in the hair of the user.

FIG. 9 is a cross sectional view of hidden foundation 20 in the hair 500 of the user (at area 9 of FIG. 8). Hidden foundation 20 is placed next to the back of the head 700 of the user, and hair 500 is gathered around hidden foundation 20. Elastic band 502 forces hair 500 onto and against waist 30 of hidden foundation 20. An article 600 (such as a bobby pin {shown}, or possibly a key, folded currency, or other small item) may be placed in storage cavity 38 before large end 26 of flared member 24 of hidden foundation 22 is placed against the back of the head 700 of the user.

Figure 10:
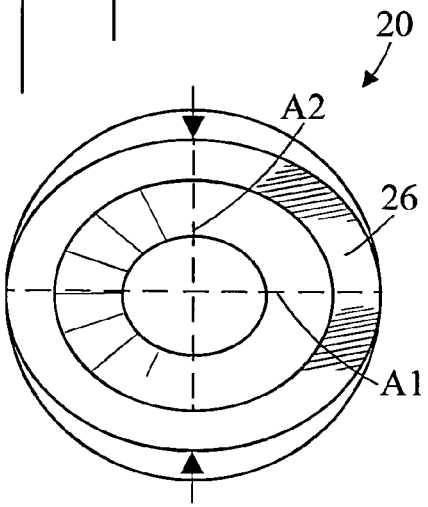
FIG. 10 is a top plan view of a second embodiment of the hidden foundation.
Figure 11:
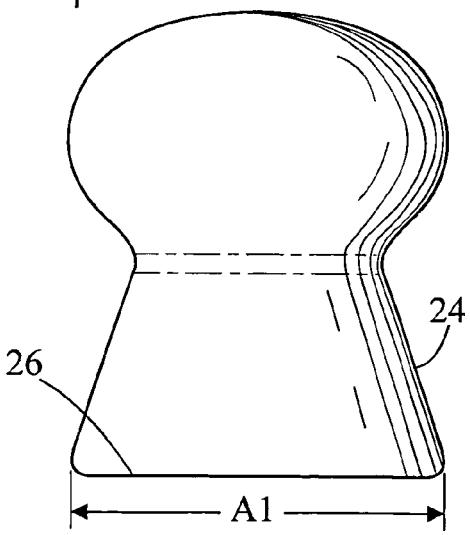
FIG. 11 is a side elevation view of the second embodiment.
Figure 12:
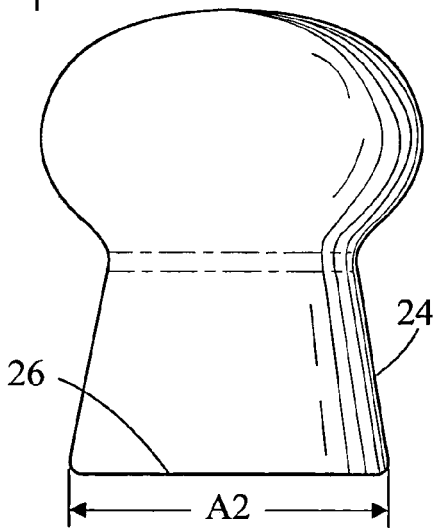
FIG. 12 is rotated side elevation view of the second embodiment.

FIGS. 10-12 are top plan, side elevation, and rotated side elevation views respectively of a second embodiment of hidden foundation 20. This embodiment is the same as the embodiment of FIGS. 1-7 except that large end 26 of flared member 24 is elliptical (rather than circular) and has a major axis A1 and a minor axis A2. That is, the cone shape of flared member 24 has been flattened in the direction of the two arrows (refer to FIG. 10). This flattened shape of flared member 24 is ideal for placement at the nape 800 or side of the user's neck (rather than at the back 700 of the head). When so placed, major axis A1 is substantially horizontal.

Figure 13:
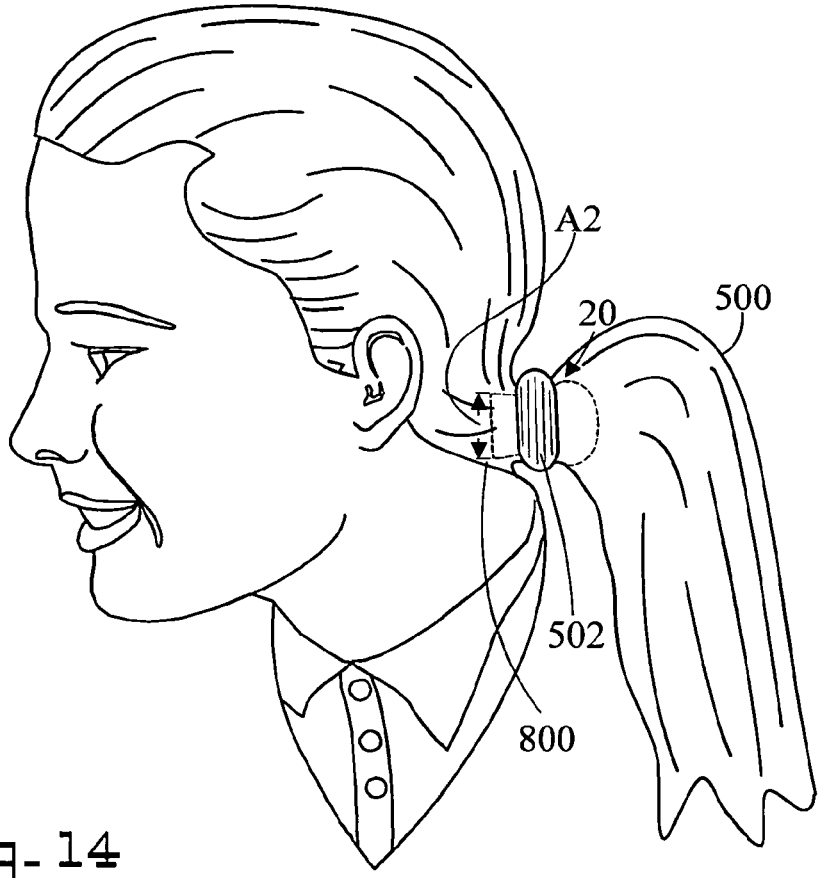
FIG. 13 is a reduced side elevation view of the second embodiment hidden foundation placed in the hair of a user.

FIG. 13 is a reduced side elevation view of the second embodiment hidden foundation 20 placed in the hair 500 of a user. Hidden foundation 20 is placed adjacent to the nape 800 of the neck of the user, and hair 500 is gathered and secured with elastic band 502 as discussed above. Minor axis A2 is substantially vertical and major axis A1 (refer to FIG. 10) is substantially horizontal.

Figure 14:
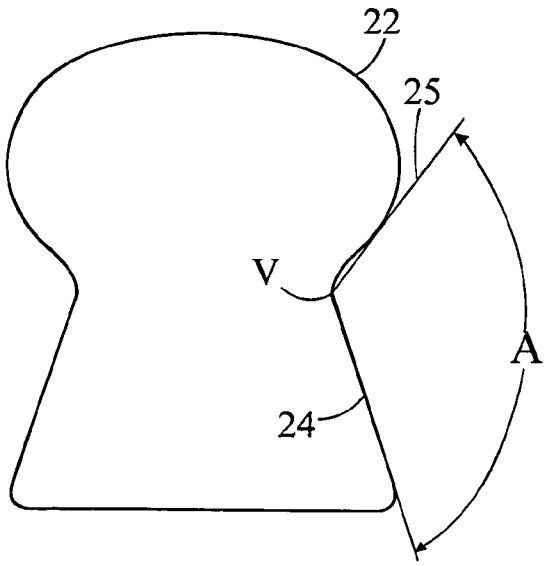
FIG. 14 is a side elevation view showing a waist angle.

FIG. 14 is a side elevation view showing a waist angle A. The vertex of waist angle A is located at the minimum width of waist 30 (i.e. the narrowest part W1 of waist 30, refer to FIG. 2). From that vertex, waist angle A is the angle between (1) a line 25 which is tangential to the lower portion of bulbous member 22, and (2) the side of flared member 24. In an embodiment, waist angle A is between about 118° and about 138°. It is noted that waist angle A, along with other features of hidden foundation 20 discussed above also apply to the third embodiment shown in FIGS. 15-18.

Figure 15:
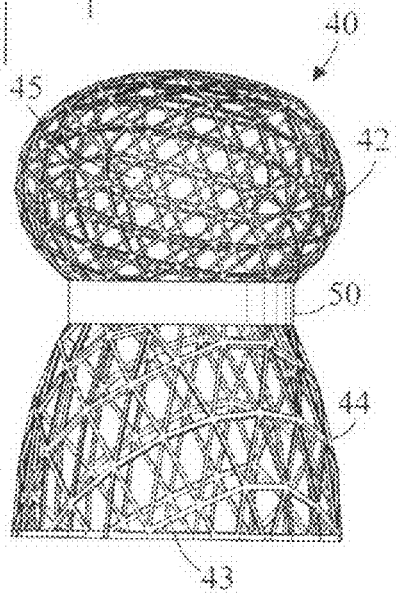
FIG. 15 is a side elevation view of a third embodiment of the hidden foundation.
Figure 16:
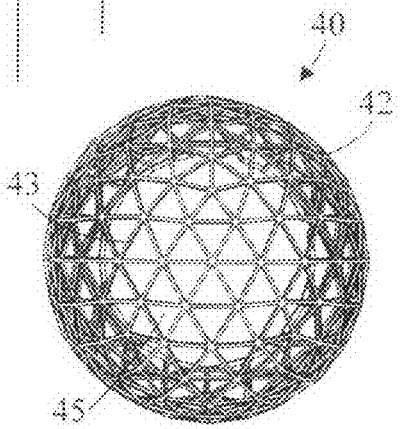
FIG. 16 is a top plan view of the third embodiment.
Figure 17:
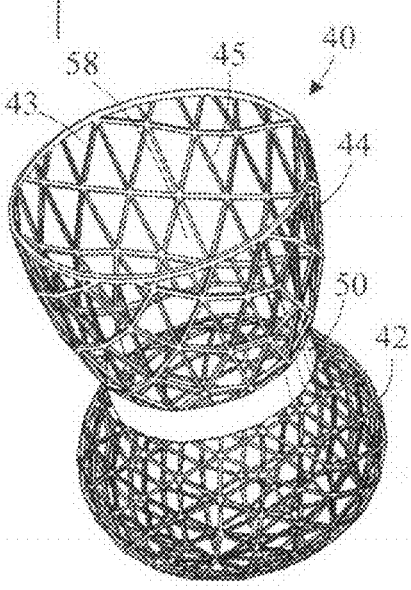
FIG. 17 is a bottom perspective view of the third embodiment.

FIGS. 15-17 are side elevation, top plan, and bottom perspective views respectively of a third embodiment of hidden foundation, generally designated as 40. The third embodiment has the same general external shape as the embodiment of FIGS. 1-7, except that in hidden foundation 40 bulbous member 42 and flared member 44 are cages formed from a lattice of connective members 43 and openings 45. Put another way, bulbous member 42 and flared member 44 comprise open-walled shells which have a plurality of openings 45 through which objects such as hair fasteners or additional adornments can be passed or clipped or fastened onto (refer to FIG. 18). In the shown embodiment, the cage of bulbous member 42 is in the form of a flattened and truncated "icosic" or "geodesic" sphere. Storage cavity 58 includes the entire volume inside the cages. Openings 45 permit the placement of pins, hair sticks, clips, and the like directly onto or through hidden foundation 40, thus eliminating the need for the wearer to attach and secure their own hair back onto itself when elaborating on the basic ponytail. In an embodiment, waist 30 is a solid band of material in order to provide structural support for the walls of the device, but could also comprise the same cage structure as bulbous member 42 and flared member 44. The embodiment of FIGS. 15-17 provides even more internal storage space, and greater airflow. Further, the openings in the cages allow the use of "hair sticks", additional pins, clips or other optional adornments by the user as well allowing the wearer to secure portions of their ponytail back onto the base of the unit for achieving a wider variety of ponytail or bun styles as desired. Hidden foundation 40 further can be used singly or in multiples such as for pigtails or other ponytail-based styles as preferred by the user. The embodiment of FIGS. 15-17 can be fabricated from a variety of materials including a metal, a polymer, or other suitable structural material which is chemically stable and non-reactive.

Figure 18:
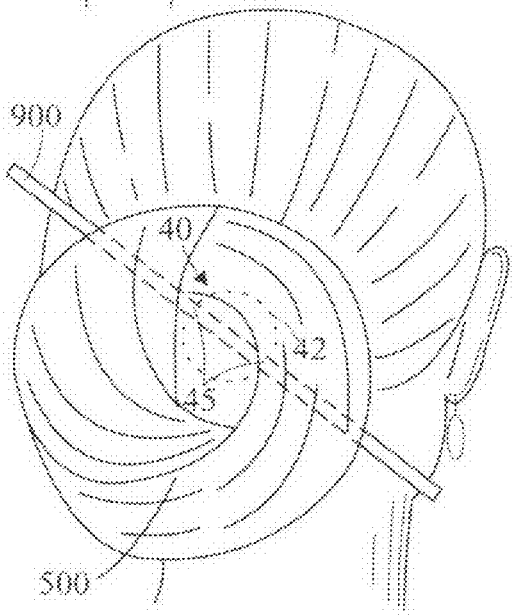
FIG. 18 is a reduced rear view of the third embodiment placed in the hair of a user.

FIG. 18 is a reduced rear view of third embodiment 40 placed on the head of a user. In the shown elaborating style, hair 500 is first placed in a ponytail using hidden foundation 40. Hair 500 is then looped around hidden foundation 40 and pinned in place with a hair fastener 900 (a hair stick in the shown embodiment) which is passed through hair 500 and opening 45 in the cage(s) of hidden foundation 40 (passed through openings 45 in bulbous member 42 as shown in FIG. 18). Hair 500 may also be twisted and/or braided to further elaborate on the basic ponytail as desired by the user.

In terms of use, a method for forming hair 500 on the back or side of the head 700 of a user includes: (refer to FIGS. 1-9)

(a) providing a hidden foundation 20 for forming hair 500 including:

a bulbous member 22;

a flared member 24 having a large end 26 and an opposite small end 28; and, a waist 30 connecting small end 28 of flared member 24 to bulbous member 22;

(b) providing an elastic band 502;

(c) placing large end 26 of flared member 24 adjacent to the back or side of the head 700 of the user;

(d) gathering hair 500 around hidden foundation 20 so that hidden foundation 20 is covered by hair 500; and, (e) placing elastic band 502 around hair 500 and waist 30.

The method further including:

providing an article 600 to be stored;

in step (a), flared member 24 including a storage cavity 38 which is accessible from large end 26, storage cavity 38 extending into bulbous member 22; and, before step (c), inserting article 600 into storage cavity 38.

The method further including: (refer to FIGS. 15-18)

in step (a), bulbous member 42 including a cage having a plurality of connective members 43 and a plurality of openings 45, and flared member 44 including a cage having a plurality of connective members 43 and a plurality of openings 45;

providing a hair fastener 900;

after step (e), looping the hair around foundation 40 and inserting hair fastener 900 through the hair and an opening 45 in foundation 40 to hold the hair in place.

Another method for forming hair 500 on the nape 800 or side of the neck of a user includes: (refer to FIGS. 10-13)

(a) providing a hidden foundation 20 for forming hair 500 including:

a bulbous member 22;

a flared member 24 having a large end 26 and an opposite small end 28, large end 26 of flared member 24 being elliptical and having a major axis A1 and a minor axis A2;

a waist 30 connecting small end 28 of flared member 24 to bulbous member 22

(b) providing an elastic band 502;

(c) placing large end 28 of flared member 24 adjacent to the nape 800 or side of the neck of the user so that major axis A1 is substantially horizontal;

(d) gathering hair 500 around hidden foundation 20 so that hidden foundation 20 is covered by hair 500; and, (e) placing elastic band 502 around hair 500 and waist 502.

The method further including:

providing an article 600 to be stored;

in step (a), flared member 24 including a storage cavity 38 which is accessible from large end 26, storage cavity 38 extending into bulbous member 22; and, before step (c), inserting article 600 into storage cavity 38.

The embodiments of the hidden foundation for forming hair and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the foundation and method should be construed as limiting the invention to a particular embodiment or combination of embodiments. The scope of the invention is best defined by the appended claims.

I claim:

1. A hidden foundation for forming hair, the foundation having a central longitudinal axis, the foundation comprising:

a flared member extending along the central longitudinal axis, the flared member having a large end for positioning adjacent the head of a user, and a small end axially spaced along the central longitudinal axis from the large end, a waist axially spaced along the central longitudinal axis from the large end of the flared member, the waist connected to the small end of the flared member, and a hollow bulbous member axially spaced along the central longitudinal axis from the flared member, the bulbous member connected to the waist and having a rounded top portion adjacent to the axis and opposite from the waist, the bulbous member defining a first plurality of openings.

2. The hidden foundation according to claim 1, further including: said flared member having a conical frustum shape having a central axis; and, said central axis coaxial with said central longitudinal axis.

3. The hidden foundation according to claim 1, the hidden foundation cooperating with an elastic band, the hidden foundation further including: said waist shaped and dimensioned to circumferentially receive the hair and the elastic band.

4. The hidden foundation according to claim 1, further including: said flared member including a storage cavity, said storage cavity accessible from said large end.

5. The hidden foundation according to claim 4, further including: said storage cavity extending into said bulbous member.

6. The hidden foundation according to claim 1, further including: said hidden foundation fabricated from a chemically-stable, non-reactive material.

7. The hidden foundation according to claim 1, further including: said hidden foundation having a length; said bulbous member having a maximum width; and, a ratio of said length to said maximum width being about 1.25.

8. The hidden foundation according to claim 1, further including: said waist disposed about one inch from said large end of said flared member.

9. The hidden foundation according to claim 1, further including: said large end of said flared member being elliptical and having a major axis and a minor axis.

10. The hidden foundation according to claim 1, further including: a waist angle which is between about 118° and about 138°.

11. The hidden foundation according to claim 1, further including: said bulbous member having a maximum width; said waist having a minimum width; and, a ratio of said maximum width to said minimum width being about 1.5.

12. A foundation member as defined in claim 1 wherein the flared member is generally hollow and defines a second plurality of openings.

13. A foundation member as defined in claim 1 wherein the bulbous member is generally centered on the central longitudinal axis, and wherein the bulbous member includes a plurality of openings adjacent the central longitudinal axis.

14. The hidden foundation according to claim 1 in combination with a hair pin extending into at least one of the plurality of openings.

15. A hidden foundation according to claim 1 wherein the bulbous member has a truncated ellipsoidal shape having a minor axis, the minor axis coaxial with the central longitudinal axis.

16. A hidden foundation for forming hair, the foundation having a central longitudinal axis, the foundation comprising:

a flared member extending along the central longitudinal axis, the flared member having a large end for positioning adjacent the head of a user and a small end axially spaced along the central longitudinal axis from the large end, a waist axially spaced along the central longitudinal axis from the large end of the flared member, the waist connected to the small end of the flared member, and a generally hollow bulbous member axially spaced along the central longitudinal axis from the flared member, the bulbous member connected to the waist and having a rounded top portion adjacent to the axis and opposite from the waist, the bulbous member having a truncated ellipsoidal shape having a minor axis, the minor axis coaxial with the central longitudinal axis.

* * * * *